United States Patent [19]

Bambara et al.

[11] 4,323,211

[45] Apr. 6, 1982

[54] SELF ADJUSTING WHEEL BEARING HEAT SIGNAL PROCESSING CIRCUIT

[75] Inventors: Joseph E. Bambara, North Babylon; W. Woodward Sanville, Brentwood, both of N.Y.

[73] Assignee: Servo Corporation of America, Hicksville, N.Y.

[21] Appl. No.: 144,770

[22] Filed: Apr. 28, 1980

[51] Int. Cl.[3] ..... G08B 21/00; B61L 3/00

[52] U.S. Cl. ..... 246/169 A; 246/169 D; 340/584; 340/600; 340/682

[58] Field of Search ..... 340/682, 600, 584; 246/169 A, 169 D, DIG. 1, DIG. 2; 250/340, 342, 338, 351

[56] References Cited

U.S. PATENT DOCUMENTS

| | | | |
|---|---|---|---|
| 3,206,596 | 9/1965 | Howell | 340/682 |
| 3,454,758 | 7/1969 | Gallagher | 246/169 D |
| 3,545,005 | 12/1970 | Gallagher | 246/169 A |
| 3,646,343 | 2/1972 | Caulier et al. | 246/169 D |
| 3,812,343 | 5/1974 | Gallagher et al. | 246/169 D |
| 3,872,456 | 3/1975 | Glazar | 246/169 D |
| 4,068,811 | 1/1978 | Caulier | 340/682 |
| 4,113,211 | 9/1978 | Glazar | 246/169 D |

*Primary Examiner*—Glen R. Swann, III

*Attorney, Agent, or Firm*—Kane, Dalsimer, Kane, Sullivan and Kurucz

[57] ABSTRACT

A railroad car hot box detector system is provided which includes a variable circuit means for processing the heat signal generated by an infra-red detector viewing a sensing zone along a section of track. The system includes a conditioning circuit which determines one or more conditions of the train (such as the wheel speed or temperature of the car bottom) and uses that information to vary the processing circuit to enable the heat signal to be processed optimally for the detected condition.

12 Claims, 4 Drawing Figures

SELF ADJUSTING WHEEL BEARING HEAT SIGNAL PROCESSING CIRCUIT

BACKGROUND OF THE INVENTION

The present invention relates to railroad car hot box detectors and more particularly to a unique system for treating the heat signal generated by such detectors.

In order to protect against railroad car wheel bearing failure, most railroads utilize hot box detectors along their rights of way to view, through infra-red scanners, the bearings of railroad cars as they pass through a sensing zone. If an overheated bearing is detected, some type of alarm is triggered to alert the engineer to stop the train and correct the potentially dangerous situation which, if allowed to continue, could result in a train derailment. While it is extremely important that no overheated bearings (i.e., hot boxes) be missed by the hot box detector, it is almost equally important that no false alarms be generated since the unscheduled stopping of a train is a costly and time consuming operation that could result in substantial disruptions of schedules.

The infra-red scanner and associated circuits for detecting overheated bearings are highly developed and available commercially from such sources as the Servo Corporation of America of Hicksville N.Y. The equipment is disclosed, for example in U.S. Pat. Nos. 3,545,005; 3,454,758; 3,812,343; 3,872,456 and 4,113,211.

Heretofore hot box detector systems of the type described in the above patents and those available commercially have been designed to safely detect hot boxes for trains passing a scanning site under a wide variety of different conditions without regard to the specific train conditions. Thus, the systems described above are designed so that they operate to process signals the same way whether the signal is generated from a train proceeding along at five miles an hour or from a high speed train moving at speeds that can exceed 100 miles per hour.

The hot box detector scanner, in effect produces a scanning spot along an optical axis which is positioned to image an area through which the train bearing is expected to pass. As a result of the train moving past the scanner, the train velocity and the scanning spot interrelate to convert the continuous spatial heat analog information of the train into continuous analog signals in the time domain. The product of train velocity in inches per second and the scanner spatial resolution per inch give the equivalent system sampling rate in time.

It has been determined that one-half the described product defines the minimum system bandwidth required to convert the spatial harmonics resolved by the scanning spot into temporal harmonics. In other words, the system bandwidth, within limits is a direct function of the speed of the passing train and the scanning spot size of the infra-red detector. However, for any particular site the scanning spot is fixed and thus the bandwidth is a function of the speed of the passing train. Typical nominal values of interest are shown in the table below:

| MPH | Train velocity Inches/Sec | Scanning Rate Spots/Sec | Minimum System Bandwidth Hz |
|---|---|---|---|
| 5 | 88 | 61.6 | 30.8 |
| 13 | 228.6 | 160 | 80 |
| 48.7 | 857 | 600 | 300 |

-continued

| MPH | Train velocity Inches/Sec | Scanning Rate Spots/Sec | Minimum System Bandwidth Hz |
|---|---|---|---|
| 60 | 1056 | 739.2 | 369.5 |
| 80 | 1408 | 985.6 | 492.8 |
| 150 | 2640 | 1848 | 924 |

From the above, it can readily be appreciated that the use of a fixed system bandwidth equal to that needed to avoid attentuation of the harmonics at the fastest anticipated train speed (i.e., 924 Hz for 150 MPH) places the system at an extreme disadvantage when the train is passing the scanning zone at lower valocities that do not need extra bandwidth since any noise with components in the extra bandwidth will be amplified and will contaminate the data obtained by the scanner.

In practice, commercial hot box detector systems are signal bandwidth limited to a constant value of about 300 Hz because a wider bandwidth allows the amplification of intolerable noise. From the above table, it can been seen that this bandwidth corresponds to a train speed of approximately 50 miles per hour. Any train passing the scanner at a velocity greater than 50 miles per hour will generate a signal with attenuated harmonics as a result of which the shape, including the peak value of the heat signal is distorted by the attenuation and the absence of the higher harmonics.

A somewhat analogous situation arises in the manner in which the value of the heat signals are treated. A hot box detector system looks for abnormal heat build up in bearings which would occur if the bearing lubricant failed or any other mechanical failure occurred. Hot box detector systems presently available treat the bearing heat signal as a value above a reference signal which may, for example, be generated by a reference heat signal source built into the system. What is important, is the rise of the bearing temperature over the general temperature of the passing train being scanned. There are many variables which effect the ability to measure the bearing temperature rise.

For the sake of safety, hot box detector systems must treat suspicious bearings as overheated bearings. This results in occasional false alarms which, are extremely costly and time consuming.

As a result of the above it is a principal object of the present invention to provide an improved hot box detector system which replaces fixed circuit values with variable values which may be tuned to conditions of the actual train being examined.

A further object is to provide such a system wherein the basic components are compatible with those of existing systems and which may readily be retrofitted into existing systems.

Still further objects and advantages will become apparent from the following description of a preferred embodiment of the invention.

SUMMARY OF THE INVENTION

The above and other beneficial objects and advantages are attained in accordance with the present invention by providing a railroad car hot box detector system which utilizes a conventional infra-red responsive scanner associated with a sensing zone along a section of track and adapted to scan railroad cars as they pass through the sensing zone and to generate an output voltage signal in response thereto. The scanner is set so that it views the wheel bearings of each passing car and the output voltage signal has an amplitude and waveform indicative of the type and condition of each bearing being scanned. The system further comprises variable circuit means for digitally processing the output signal and conditioning circuit means for varying the processing circuit in response to physical conditions of the train. The physical conditions may comprise the speed of the train and/or temperature of the train which can be used by the conditioning circuit to set the system bandwidth and establish relative ambient temperature values for use in the subsequent processing of the heat signal.

DETAILED DESCRIPTION OF THE PREFERRED EMBODIMENT

Figure 1:
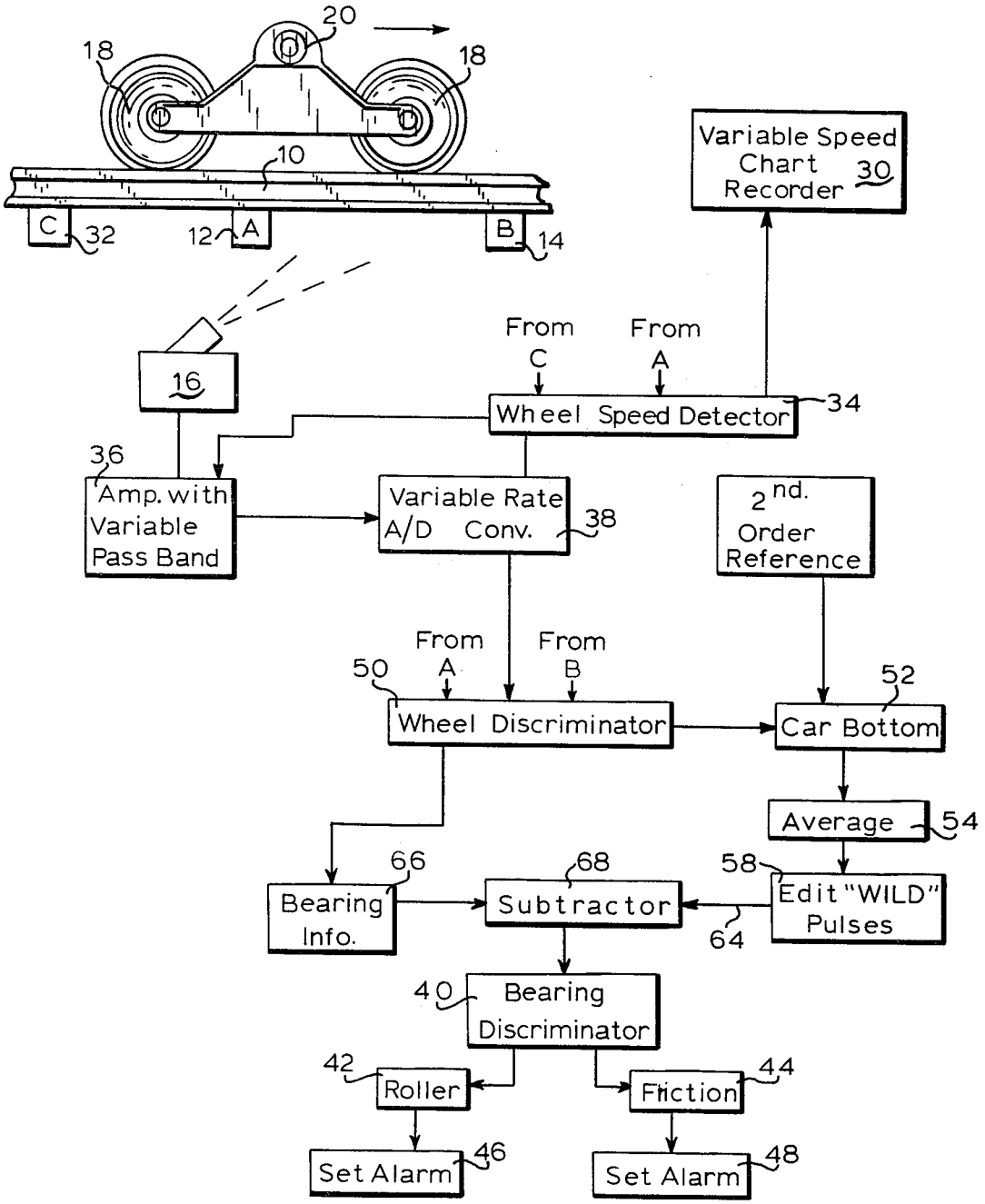
FIG. 1 is a block diagram representation of the overall system of the present invention.

Reference is now made to the drawings and to FIG. 1 in particular wherein a section of railroad track 10 is depicted along which a pair of wheel sensor 12 and 14 are mounted. An infra-red hot box detector 16 such as that disclosed in U.S. Pat. No. 3,545,005 is positioned along the track to scan each passing railroad car as the car passes through the sensing zone defined by wheel sensors 12 and 14. The scanner is focused to image on the bearings of each wheel. In practice a pair of scanners are usually provided mounted on opposite sides of the track with each scanner imaging on the bearings on its side of the track. The wheel sensors (12 and 14) and infra-red scanner 16 are of conventional design and are commercially available from the aforementioned Servo Corporation of America of Hicksville, N.Y. In operation the wheel sensors serve to generate a signal each time a wheel passes over the sensor.

Figure 2:
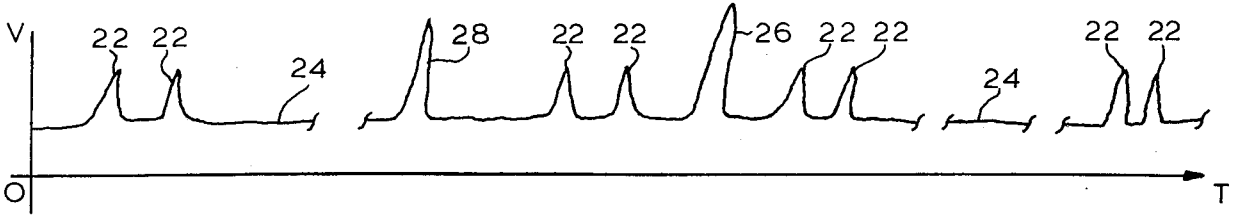
FIG. 2 is a simplified wavefom diagram of the heat signal generated by the passage of a train through a sensing zone.

The output of scanner 16 comprises an analog waveform the general shape of which is as shown in FIG. 2. As each of the wheels 18 on truck 20 passes through the sensing zone a heat pulse 22 is generated. Between trucks 20, the scanner 16 views the undercarriage or bottom of the passing car and during that period a signal 24 representative of the temperature of the car bottom is produced. Between cars the scanner 16 may get a glimpse of the sky which could generate an extraneous hot or cold pulse 26. Occasionally a car will carry a steam pipe along its undercarriage which, if viewed by the scanner 16, will appear as a spurious heat signal 28.

Most hot box detector systems incorporate some type of chart recorder which produces a permanent record of the heat signals generated by the scanner 16. The chart recorder may be located at the actual scanner site or connected to the site through a communications channel such as a telephone line. Through techniques well known and defined in the art, the chart recorder turns on before the first wheel of the first car passes through the sensing zone and turns off after the last wheel of the last car has passed through the zone and thereby provides a permanent record of the heat condition of the passing train. By isolating groups of wheels, the chart recorder readout also provides information as to the length of a passing train, makeup of the train, etc.

In accordance with the present invention, an additional wheel sensor 32 is provided upstream of the first wheel sensor 12. By fixing the distance $\overline{CA}$ and determining the time it takes for each wheel to trip wheel sensor 12 after tripping wheel sensor 32, the speed of each wheel 18 can be determined as it enters the sensing zone $\overline{AB}$ between wheel sensors 12 and 14. The speed determination is made in a speed detector 34 which, for example, could count the pulses from a fixed clock during the period of time it takes for each wheel to pass from wheel sensor 32 to wheel sensor 12.

The output of wheel speed detector 34, which is an indication of the speed of each wheel as it enters the sensing zone, may be used for a wide variety of functions in accordance with the present invention. As shown, the wheel speed information may be used to control the speed of a variable speed chart recorder 30. In this way, the time spacing for a fast moving train could be spread out or that for a slow train could be consolidated so as to provide generally uniform output waveforms regardless of train speed.

In addition the wheel speed information is fed to control the variable passband of a scanner smplifier 36. By controllig the passband in accordance with the previous chart to set a minimum bandwidth match to the actual velocity of each wheel entering the sensing zone the train velocity can be utilized to conrol the system analog bandwidth and hence filter out noise components of the heat signal at an initial stage. This is particularly useful for trains passing through the sensing zone at relatively slow or moderate speeds (i.e., slower than 50 mph) since the bandwidth can be limited considerably. In addition, for high speed trains (i.e. above 50 mph) the train speed information may be used to inject compensation for changes in waveshape that result from alteration of the higher frequency harmonics.

The present invention is particularly applicable to a hot box detector system in which the heat signal is processed digitally in a manner as disclosed in the currently pending and commonly assigned application Ser. No. 135,628 filed Mar. 31, 1980 for RAILROAD CAR WHEEL BEARING HEAT SIGNAL PROCESSING CIRCUIT. It should be noted that the system analog bandwidth is controlled prior to analog/digital conversion of the heat signal which occurs in A/D converter 38. the A/D converter serves to convert the analog heat signal of FIG. 2 into a series of discrete voltage values occuring at fixed time intervals dependent upon the sampling rate of A/D conversion. Since the speed of the train will determine the length, in time, of the waveform of FIG. 2, and since the scanning spot size determines the maximum number of useful samples that can be obtained, the wheel speed information from detector 34 can be used to control the A/D sampling rate to minimize the processing of redundant data. In other words, if the rate of A/D sampling were not controlled, a train travelling at 10 miles per hour would provide five times the samples of a train travelling at 50 miles per hour through the sensing zone. The use of train speed to control A/D sampling enables uniform A/D spatial sampling conversions regardless of train speed.

The determination of the type of bearing under observation is made in a bearing discriminator circuit 40 such as that disclosed in the previously mentioned co-pending and commonly assigned application Ser. No. 135,628 filed Mar. 31, 1980 for RAILROAD CAR WHEEL BEARING HEAT SIGNAL PROCESSING CIRCUIT. It sufficies to say for the present application that the discriminator 40 determines whether the heat signals 22 are produced by roller bearings or friction bearings and its output is connected to roller and friction bearing processing circuits 42 and 44 respectively which determine if an overheated condition exists for the type of bearing and if so, to set appropriate alarms 46 or 48.

Figure 3:
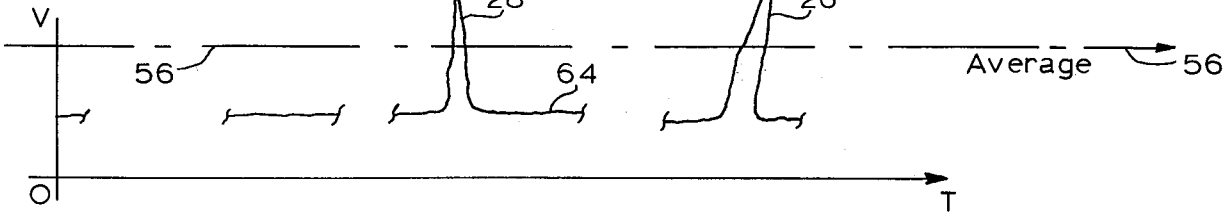
FIG. 3 is a simplified waveform similar to FIG. 2 showing the heat signal with bearing information removed.
Figure 4:
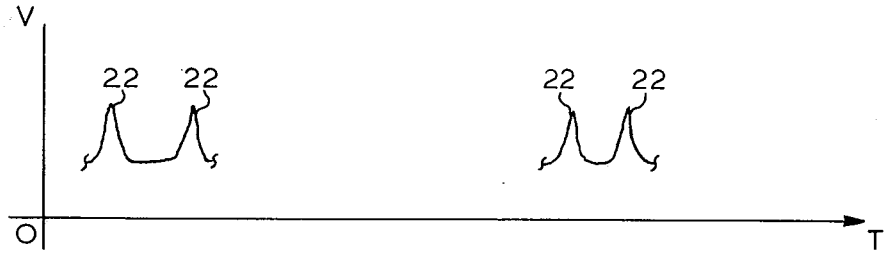
FIG. 4 is a simplified waveform similar to FIG. 2 showing the heat signal with all information other than bearing information removed.

As previously mentioned, it is desireable that the reference temperature over which the bearing heat level rises should be related to the car bottom to determine if an alarm condition exists. Heretofore, at best, the car bottom temperature could only be crudely approximated and any spurious signal would greatly effect the determination of a car bottom temperature value. In distinction, the system of the present invention more accurately establishes a reference temperature above which alarms are triggered by editing out spurious signals from a determination of the car bottom temperature as a reference. To this end, the output of A/D converter 38 is fed to a wheel discriminator 50 which isolates those portions of the wave form of FIG. 2 which represent actual wheel bearings from the remainder of the waveform. The wheel discriminator circuit 50 in effect acts as a gate conrolled by inputs from wheel sensors 12 and 14 to pass the portions of the heat signal which occur when no wheel is in the sensing zone for processing for car bottom temperature information and to pass the portions of the heat signal which occur when a wheel is present in the sensing zone for processing for wheel bearing temperature information. In effect, discriminator 50 separates the sampling of the waveform of FIG. 2 into samples which occur in time segments during the passage of each wheel between sensors 12 and 14 and samples which occur in time segments during which no wheel passes between sensors 12 and 14. The samples from the waveform during the later time segments are fed to car bottom detector 52 and are generally depicted in FIG. 3. It should be noted that while samples representing the wheel signals of FIG. 2 have been removed from the waveform of FIG. 3, samples representing the spurious heat signals 26 and 28 have not been removed. To remove the spurious signal samples, the car bottom samples are fed to an arithmetic averaging device 54 which establishes an initial average (indicated by lie 56 of FIG. 3 of the car bottom heat signals). The "wild" pulses 26 and 28 are excluded in the determination of the average 56, by eliminating all samples above or below a fixed threshold value from the average in editing circuit 58.

The bearing heat signals samples from discriminator 50 are fed to a suitable storage device 66 from which they are subsequently recalled and fed to an input of a numerical subtracting circuit 68 the other input to which is the true reference heat level 64 of the passing train. The difference between the two (i.e., the output of subtractor 68) accurately reflects the rise in temperature of the train wheel bearings over a true reference temperature derived from the train itself. The signal may then be processed as described in the previously mentioned copending application.

By introducing into the car bottom storage device 52 second order reference information, such as the actual ambient temperature, a more accurate reference heat level 64 may be developed for subsequent use in determining the bearing temperature rise.

Thus, in accodance with the above, the aforementioned objectives may be attained.

Having thus described the invention, what is claimed is:

1. A railroad car hot box detector system comprising:

infra-red responsive scanner means positioned along a section of track and adapted to scan passing railroad cars within a sensing zone along said track and to generate a signal in response thereto, said signal including portions thereof having an amplitude and waveform indicative of the passing of a wheel bearing and the temperature and type thereof;

variable circuit means for digitally processing samples of said signal to determine the condition of said bearing; and, conditioning circuit means for detecting physical conditions of said car including car speed and for varying said processing circuit in response to said car conditions.

2. The invention in accordance with claim 1 wherein said processing circuit includes variable bandpass filter means and said conditioning circuit includes means for adjusting the bandwidth of said filter as a function of the speed of said railroad car as it travels through said sensing zone.

3. The invention in accordance with claim 2 wherein said processing circuit includes a variable sample rate analog/digital converter connected to the output side of said bandpass filter and said conditioning circuit includes means for adjusting said converter sample rate as a function of the speed of said car as it passes through the sensing zone.

4. The invention in accordance with claim 1 or 2 wherein said processing circuit includes a variable speed chart recorder and said conditioning circuit includes means for adjusting said recorder speed as a function of the speed of said car as it passes through said sensing zone.

5. The system in accordance with claims 1 or 2 wherein said conditioning circuit includes means for establishing a reference temperature for the bottom of each car being scanned and said processing circuit includes means for subtracting said reference temperature from the wheel bearing portion of said scanner signal.

6. The system in accordance with claims 1 or 2 wherein: said conditioning circuit includes means for establishing a reference temperature for the bottom of each car being scanned including means for isolating samples of said scannaer signal containing wheel bearing information from the remaining samples of said signal;, means for establishing an average value for said remaining samples, and means fo editing out all samples that deviate by a predetermined amount from said average value whereby to establish said reference temperature.

7. A railroad car hot box detector system comprising:

infra-red responsive scanner means associated with a sensing zone along a section of track adapted to scan bearings of a railroad car within said sensing zone and to generate an output voltage signal in response thereto having an amplitude and waveform indicative of the type of bearing being scanned;

first circuit means including a variable bandwidth passband filter; and, second circuit means responsive to the speed of the train passing through said sensing zone for varying the bandwidth of said filter as a function of the speed of said train.

8. A method for processing the signal from a railroad car hot box detector system of the type including an infra-red scanner positioned along a section of track and adapted to scan passing railroad cars within a sensing zone along said track and to generate a signal in response thereto which includes portions having an amplitude and waveform indicative of the passing of a wheel bearing and the temperature and type therefore and means for processing said signal, comprising the steps of:

(a) determining the speed of said car prior to its entering said sensing zone; and (b) varying the bandwidth of said signal processing means as a function of the detected speed of said car.

9. A method for processing the signal from a railroad car hot box detector system of the type including an infra-red scanner positioned along a section of track and adapted to scan passing railroad cars within a sensing zone along said track and to generate a signal in response thereto which includes portions having an amplitude and waveform indicative of the passing of a wheel bearing and the temperature and type thereof and means for processing said signal including a variable sample rate analog/digital converter comprising the steps of:

(a) determining the speed of said car prior to said cars entering said sensing zone.

(b) varying the sample rate of said A/D convertor as a function of the determined speed.

10. The method in accordance with claim 9 further comprising the step of:

(a) varying the bandwidth of said signal processing means as a function of the determined speed.

11. The method in accordance with claim 9 or 10 comprising the further steps of:

(a) separating those portions of the signal which result from the passage of a wheel bearing through said sensing zone from the remainder of said signal;

(b) determining an average value of said remainder of said signals which average value represents the temperature of the bottom of the passing car; and (c) subtracting said average value from said separated portion prior to further processing said separated portions to determine the temperature and type of the wheel bearing.

12. The method in accordance with claim 9 or 10 comprising the further steps of:

(a) separating those portions of the signal which result from the passage of a wheel bearing through said sensing zone from the remainder of said signal;

(b) determining an average value of said remainder of said signals, which average value represents an approximation of the temperature of the bottom of the passing car;

(c) eliminating all portions of said remainder of said signals which deviate from said average by a predetermined amount; and, (d) subtracting said average value from said separated portions prior to further processing said separate portions to determine the temperature and type of the wheel bearing.

* * * * *